US006926361B2

(12) United States Patent
Link

(10) Patent No.: US 6,926,361 B2
(45) Date of Patent: Aug. 9, 2005

(54) DEVICE FOR ADJUSTING A SEAT DEPTH OF A CHAIR

(75) Inventor: Werner Link, Messstetten (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 0 days.

(21) Appl. No.: 10/691,184

(22) Filed: Oct. 22, 2003

(65) Prior Publication Data

US 2004/0104612 A1 Jun. 3, 2004

(30) Foreign Application Priority Data

Oct. 22, 2002 (DE) ..... 102 49 335

(51) Int. Cl.[7] ..... B60N 2/02
(52) U.S. Cl. ..... 297/337; 297/284.11
(58) Field of Search ..... 297/337, 284.11, 297/284.7

(56) References Cited

U.S. PATENT DOCUMENTS 5,380,063 A * 1/1995 Dauphin ..... 297/284.11 X

FOREIGN PATENT DOCUMENTS

| | | | |
|---|---|---|---|
| DE | 40 40 138 | A1 | 6/1992 |
| DE | 93 00 810.4 | | 7/1994 |
| DE | 0 962 170 | A2 | 12/1999 |
| DE | 199 15 327 | C1 | 1/2001 |
| EP | 0 585 753 | A1 | 3/1994 |

* cited by examiner

*Primary Examiner*—Anthony D. Barfield
(74) *Attorney, Agent, or Firm*—Michael J. Striker

(57) ABSTRACT

A device for adjusting a seat depth of a chair has a seat carrier, an adjusting part which is arranged pullable out on a front edge of the seat carrier, a spindle rotatably supported in the adjusting part, two nuts arranged on the spindle so that during a rotation of the spindle they move on the spindle in opposite directions, and two braces hingedly supported on the seat carrier and connected with the nuts.

11 Claims, 1 Drawing Sheet

11
17
21
16.1
18
18.1
22
14
16
18
18.1
15
21
17
12
20
19
19
13
13
10.1
10

DEVICE FOR ADJUSTING A SEAT DEPTH OF A CHAIR

BACKGROUND OF THE INVENTION

The present invention relates to a device for adjustment of a seat depth of a chair with the seat carrier.

Seat depth adjusting device are used nowadays in high-quality office chairs for providing optimal adjustment of the chair to people with different body sizes.

The adjustment must be provided with simple structural means and in the case of a cushioned seat carrier must be such that the cushion is rolled on and off during the adjustment of the seat depth without folding the same.

SUMMARY OF THE INVENTION

Accordingly, it is an object of the present invention to provide a device for adjusting a seat depth of a chair, which satisfies the above mentioned requirements.

In keeping with these objects and with others which will become apparent hereinafter, one feature of the present invention resides, briefly stated, in a device for adjusting a seat depth of a chair with the seat carrier, which is provided with an adjusting part arranged so that it can be pulled out at the front edge of the seat carrier, with a rotatably supported spindle, wherein two nuts are associated with a spindle and move during a rotation of the spindle in opposite directions, and a brace which is hingedly supported on the seat carrier and connected to them.

During a rotation of the spindle, the nuts move either outwardly or inwardly. As a result, the braces connected to the nuts extend either in the seat longitudinal direction or opposite to it at a great angle. Depending on the position of the braces, the adjusting part is pulled from the seat carrier more or less and thereby the seat depth becomes greater or smaller. The connecting point of the braces on the seat carrier can be provided for example in the region of the perpendicular central plane in the seat direction of the seat carrier. During movement of the nuts to one another by rotation of the spindle, the seat depth is increased, while a turning of the spindle in the opposite direction moves the nuts away from one another so as to shorten the seat depth. The spindle can be provided with oppositely directed threaded portions for producing the oppositely directed movement of the nuts. The threaded portion can meet for example in the center of the spindle.

The structural solution for the pulling out of the adjusting part can have different variants. In accordance with a preferable embodiment the adjusting part can be arranged pullable-out on the seat body by two guide tubes which are fixedly connected with the adjusting part and are displaceable on the seat carrier. This provides for a very low friction change of the position of the adjusting part.

The rotation of the spindle can be performed by at least one hand wheel, preferably by two hand wheels, so that the adjustment can be performed both with the left hand and with the right hand.

For a cushioned seat carrier, also a cushion receiving tube can be arranged coaxially to the spindle. The cushion front edge can be mounted on it, and also, it can have at least one guiding slot extending over a longitudinal portion, through which the nuts can be guided outwardly. With the corresponding shape of the guiding slot, for example with the shape of two opposite threads with great pitch, during a rotation of the spindle the cushion receiving tube is also displaced to perform a light rotation by displacing the nuts along the guiding slot. With this rotation of the cushion receiving tube, the cushion during a shortening of the seat depth can be roll on and during a lengthening of the seating depth can be again unrolled.

The course of the guiding slot and the thread pitch of the spindle can be selected with respect to one another so that during a change of the seat depth the cushion can be rolled on the cushion receiving tool or rolled from the cushion receiving tool without folds. The guiding slot of the cushion receiving tube can be determined individually with respect to its shape and length, in correspondence with the different seat carriers. There is a possibility to form the guiding slot V-shaped with the tip of the V located at least approximately near the tube center. In this way a linear displacement can be obtained, when the spindle is rotated.

The cushion can be mounted on a cushion receiving tube by a strip.

The adjusting part can be provided with a carrier element or a cover, which together forms a receptacle for the cushion receiving tube and the spindle arranged in it. The tube and the spindle roll in the receptacle. The cushion receiving tube can be supported on the spindle by lateral guiding bushes.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is an explosion view of a seat carrier with a seat depth adjusting device.

DESCRIPTION OF THE PREFERRED EMBODIMENTS

Figure 2:
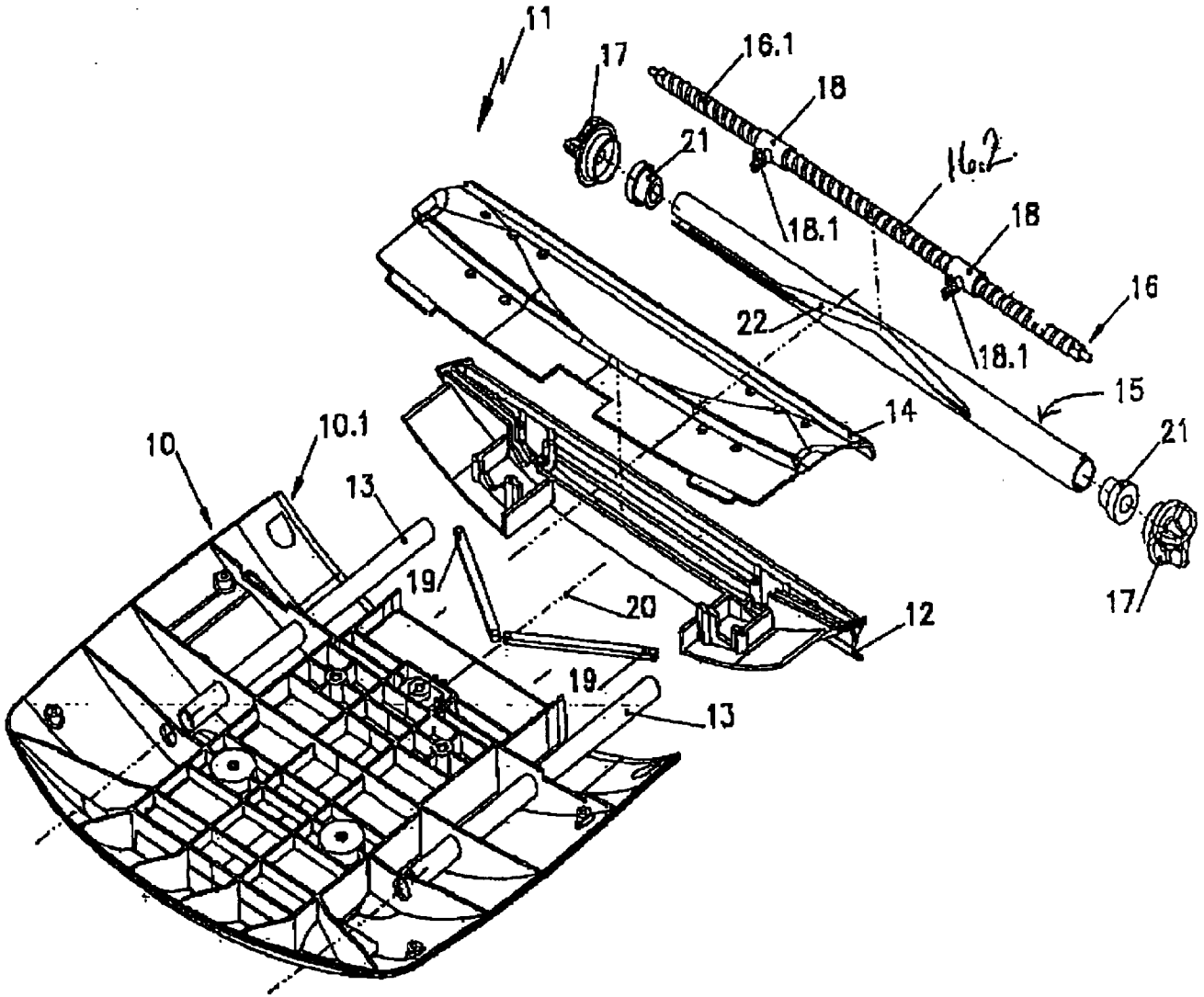

A seat depth adjusting device of the present invention is identified as a whole with reference numeral 11. The seat depth adjusting device 11 is arranged on a front edge 10.1 of the seat carrier 10.

The seat carrier 10 is provided with a not shown cushion on the upper side. The seat depth adjusting device 11 has a carrier part 12 which is supported on two guiding tubes 13 on the seat carrier 10 so as to be capable of being pulled out. The carrier part 12 is covered by a cover 14 from above. Together with the carrier part 12, the cover 14 in the front region forms a receptacle for a cushion guiding tube 15, and for a spindle 16 which is arranged inside the cushion guiding tube 15. The receptacle is closed over more than 180°.

The spindle 16 can be rotated by hand wheels 17. The hand wheels are provided with two oppositely directed threaded portions 16.1 and 16.2. Nuts 18 are arranged on the threaded portions. The nuts 18 have articulated connecting points 18.1 for two braces 19, which are pivotally supported on the seat carrier 10 with their opposite ends.

The connecting points of the braces 19 of the seat carrier 10 are located closely near the perpendicular central plane 20 of the seat carrier 10. Thereby during movement of the nuts 18 toward one another the carrier part 12 is moved outwardly due to the rotation of the spindle 16 by a hand wheel 17 further on the guide tubes 13. Thereby the seat depth is increased. In contrast, when the nuts 18 are moved away from one another, then during rotation of the spindle 16 in opposite direction the braces 18 are significantly angled. Thereby the carrier part 20 and the cover 14 which is fixedly screwed with it are moved further on the guiding tube 13 inwardly in direction to the seat carrier 10.

The cushion receiving tube 15 is supported on the spindle 16 by lateral guiding bushings 21. The front edge of the not shown cushion is mounted on the cushion receiving tube 15, for example by a strip. The cushion receiving tube 15 also has a guiding slot 22 which extends over a part of the length of the guiding tube 15. It has a V-shaped region.

The connecting points 18.1 of the nuts 18 extend through the guiding slot 22. With the shape of the guiding slot 22 and a corresponding selection of the pitch of the threaded portion 16.1 of the spindle 16, it can be guaranteed that the rotation movement of the spindle 16 is converted into a linear movement of the support part 12 and the cover 14. Simultaneously it is guaranteed that the cushion, during unrolling from and rolling on the cushion receiving tube 15, remains fold-free.

It will be understood that each of the elements described above, or two or more together, may also find a useful application in other types of constructions differing from the types described above.

While the invention has been illustrated and described as embodied in device for adjusting a seat depth of a chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for adjusting a seat depth of a chair, comprising a seat carrier; an adjusting part which is arranged pullable out on a front edge of said seat carrier; a spindle rotatably supported in said adjusting part; two nuts arranged on said spindle so that during a rotation of said spindle said nuts move on said spindle in opposite directions; and two braces hingedly supported on the seat carrier and connected with said nuts, wherein said seat carrier is cushioned; and further comprising a cushion receiving tube arranged coaxially to said spindle for mounting a front end of a cushion, said cushion receiving tube having a guiding slot extending at least over a portion of its length, said nuts being guiding outwardly through said slot, so that during rotation of said spindle also said cushion receiving tube is rotated as well.

2. A device as defined in claim 1, wherein connecting points of said braces for connecting said braces to said seat carrier are arranged in a region of a perpendicular central plane in a seat direction of said seat carrier.

3. A device as defined in claim 1, wherein said spindle has two oppositely directed threaded portions.

4. A device as defined in claim 1, wherein said adjusting part is arranged so that it can be pullable from said seat carrier by two guiding tubes which are fixedly connected with said adjusting part and are displaceably supported on said seat carrier.

5. A device as defined in claim 1; and further comprising at least one hand wheel operative for rotating said spindle.

6. A device as defined in claim 1, wherein said guiding slot has a course and said spindle has a thread pitch which are selected with respect to one another, so that during a change of a seat depth the cushion is rollable on said cushion receiving tube and unrollable from said cushion receiving tube without folding.

7. A device as defined in claim 6, wherein said guiding slot has a shape of two oppositely directed threads with a great pitch.

8. A device as defined in claim 1, wherein said guiding slot has a V-shape with a tip arranged at least approximately in a center of said cushion guiding tube.

9. A device as defined in claim 1; and further comprising means for mounting the cushion on said cushion receiving tube and including a strip.

10. A device as defined in claim 1, wherein an adjusting part includes a carrier element and a cover which together form a receptacle for said cushion receiving tube and said spindle.

11. A device as defined in claim 1; and further comprising lateral guiding bushes for supporting said cushion receiving tube on said spindle.

* * * * *